United States Patent [19]

Ochs

[11] Patent Number: 4,813,561

[45] Date of Patent: Mar. 21, 1989

[54] COMPOSITE RETORTABLE CLOSURE

[75] Inventor: Charles S. Ochs, Lancaster, Ohio

[73] Assignee: Anchor Hocking Corporation, Lancaster, Ohio

[21] Appl. No.: 161,726

[22] Filed: Feb. 29, 1988

[51] Int. Cl.[4] ..... B65D 41/34

[52] U.S. Cl. ..... 215/252; 215/276

[58] Field of Search ..... 215/252, 276, 274, 275

[56] References Cited

U.S. PATENT DOCUMENTS

| | | | |
|---|---|---|---|
| 3,504,818 | 4/1970 | Crisci | 215/252 |
| 4,093,094 | 6/1978 | Smalley et al. | 215/276 |
| 4,478,343 | 10/1984 | Ostrowski | 215/252 |
| 4,592,476 | 6/1986 | Yasada | 215/252 |
| 4,694,969 | 9/1987 | Granat | 215/252 |
| 4,694,970 | 9/1987 | Hayes | 215/276 X |

*Primary Examiner*—Donald F. Norton

*Attorney, Agent, or Firm*—Stoll, Previto & Hoffman

[57] ABSTRACT

A closure is described for sealing retortable containers. The closure has a disc shaped metal cover with a grooved sealing portion at its outer edge containing a sealant and a plastic ring for engaging the container. A clamping action holds sealant in the cover groove against a rim of the container and the relative dimensions of the closure groove and the container are chosen for providing a tight seal particularly after retorting.

11 Claims, 4 Drawing Sheets

Fig. 1.
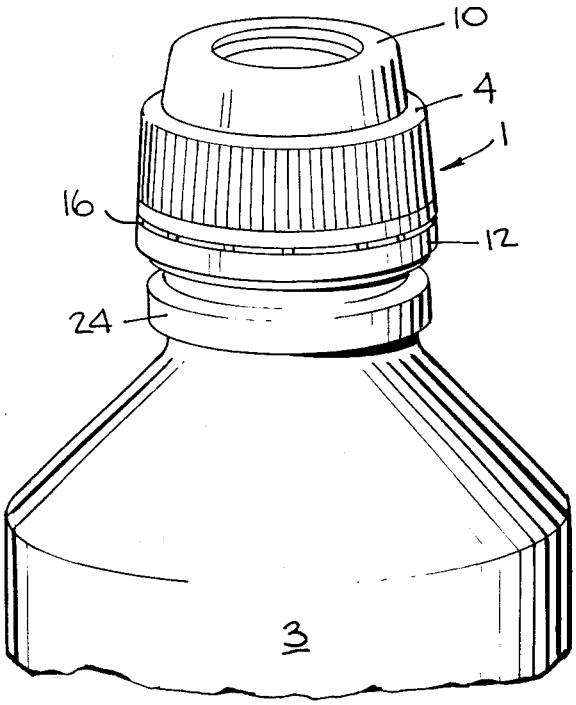
Fig. 2.
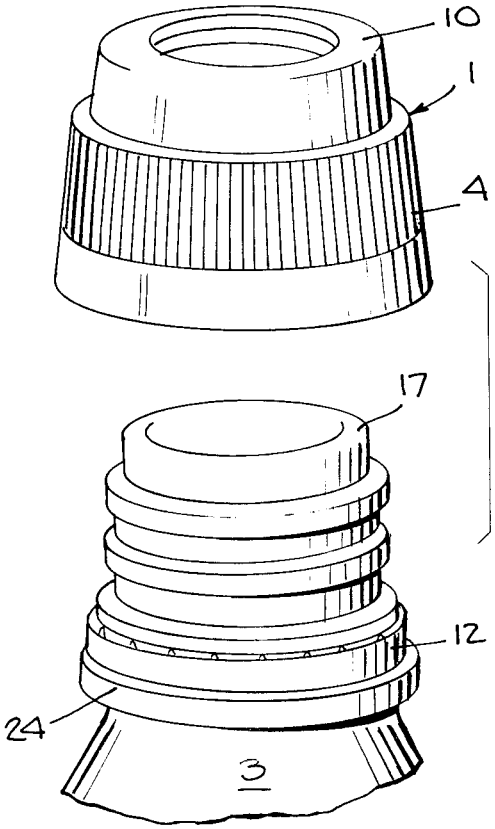
Fig. 3.
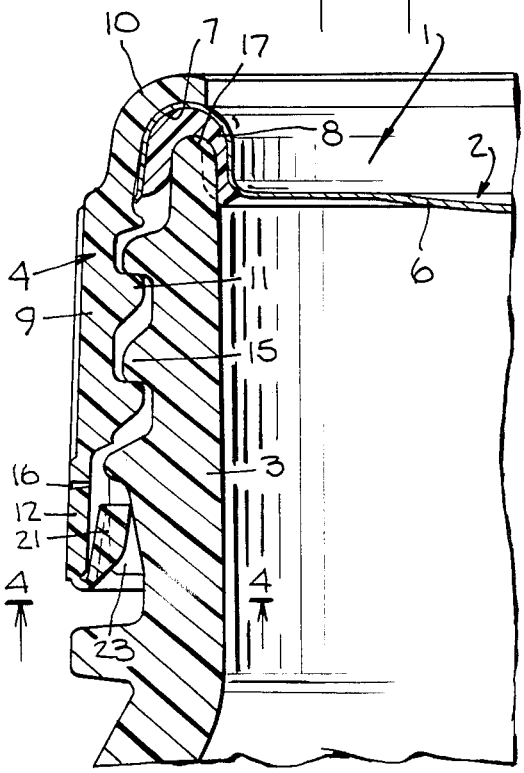
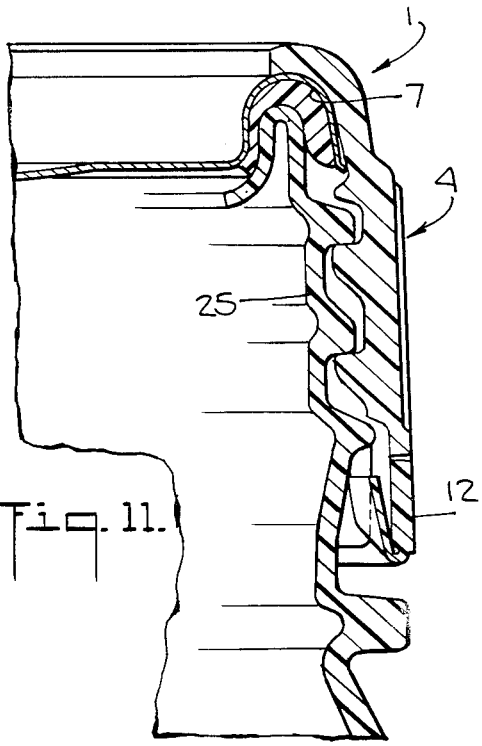
Fig. 11.

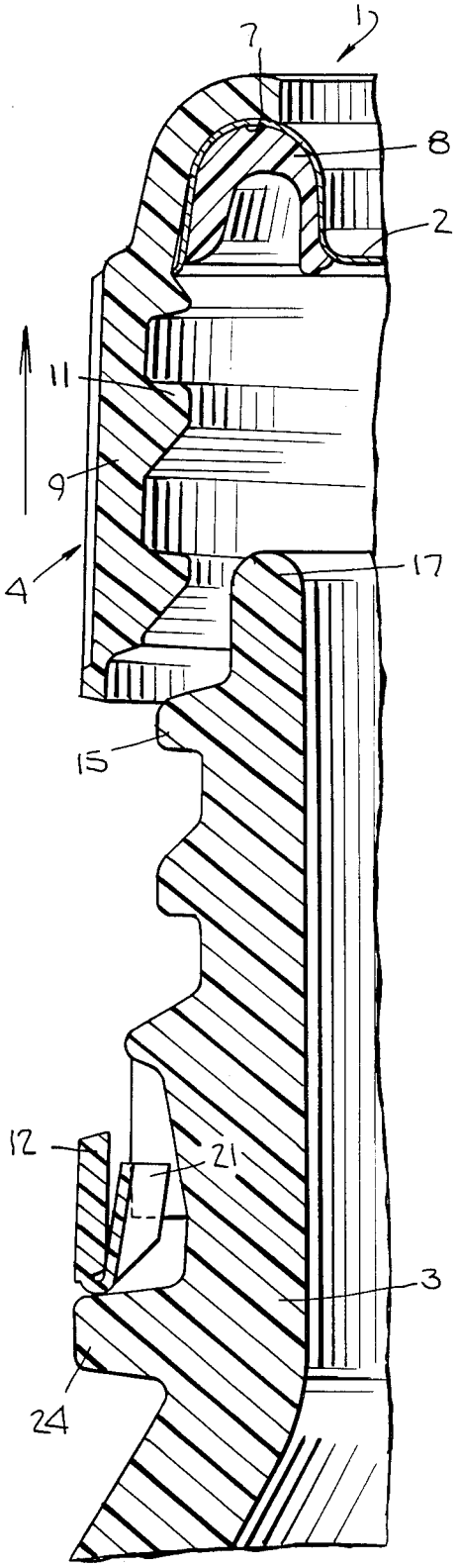
Fig. 9.
Fig. 10.
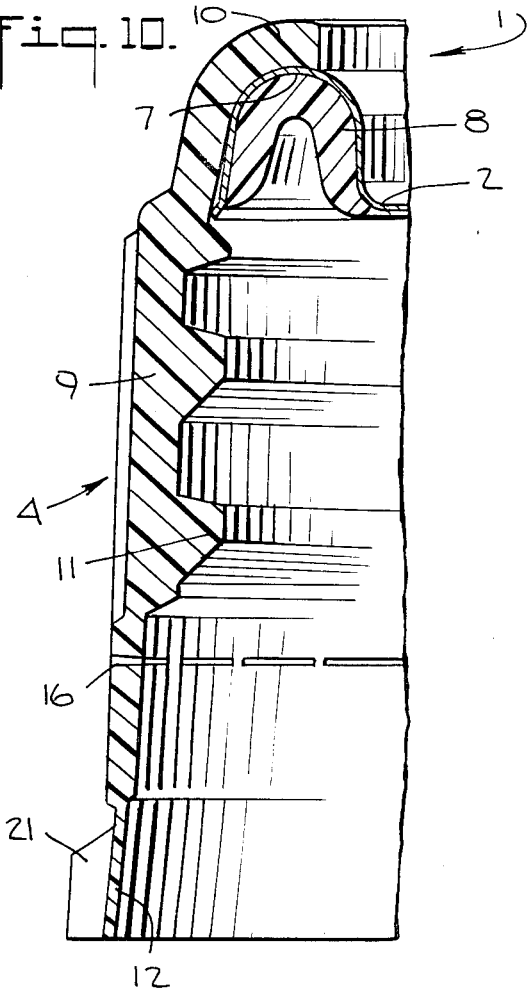
Fig. 4.
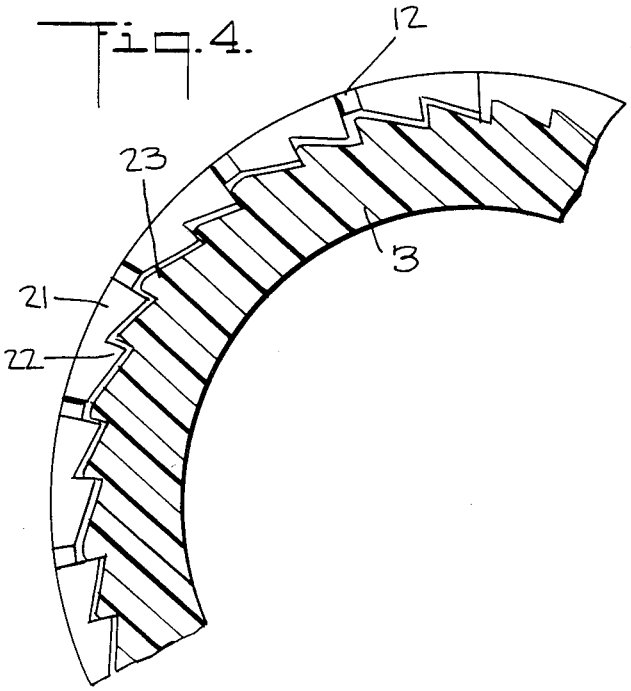

COMPOSITE RETORTABLE CLOSURE

BACKGROUND OF THE INVENTION

The present invention relates to an improved closure for sealing retortable containers and more particularly for a closure for sealing cans and wide mouth containers including barrier plastic containers and for retaining the seal during and after the retorting of the sealed package.

There is a type of container for foods and similar products which whether molded or otherwise formed from plastic or metal has a relatively thin rim. Some such containers are molded wide mouth barrier plastic containers which are used for food packaging with a retorting operation.

The composite closure comprises a metal disc cover having a clamp-like or grooved edge containing a sealant for sealing the container and a molded plastic ring for holding the cover on the container. A portion of the sealant on the closure groove is clamped against the container rim in a broad annular band with the seal being relatively insensitive to container size changes during the heating of a retorting process.

Accordingly, an object of the present invention is to provide an improved composite closure for retortable containers.

Another object of the present invention is to provide an improved composite closure for barrier plastic containers.

Another object of the present invention is to provide an improved resealable composite closure for containers which has an improved seal after retorting.

Another object of the invention is to provide an improved tamper evident composite closure.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view of a sealed package in accordance with the present invention.

FIG. 2 is an exploded perspective view of the package of FIG. 1.

FIG. 3 is a vertical cross-sectional view of a preferred embodiment of the retortable closure in accordance with the present invention.

FIG. 4 is a fragmentary horizontal sectional view illustrating the tear band and container ratchets.

FIG. 9 is an enlarged vertical sectional view of the package after opening.

FIG. 10 is a vertical sectional view of the closure cap of the invention after molding.

FIG. 11 is a fragmentary vertical sectional view of a blow or vacuum formed container finish for sealing with a closure cap in accordance with the present invention.

DESCRIPTION OF THE PREFERRED EMBODIMENT

Figure 5:
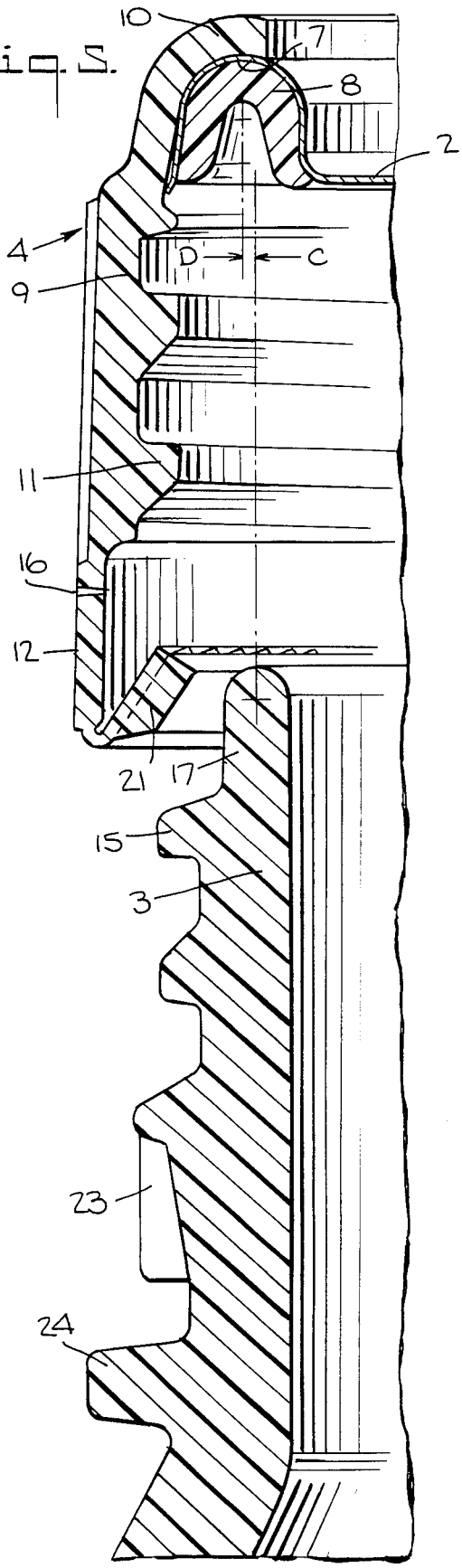
FIGS. 5 thru 8 are enlarged vertical sectional views of the package before and after sealing.
Figure 6:
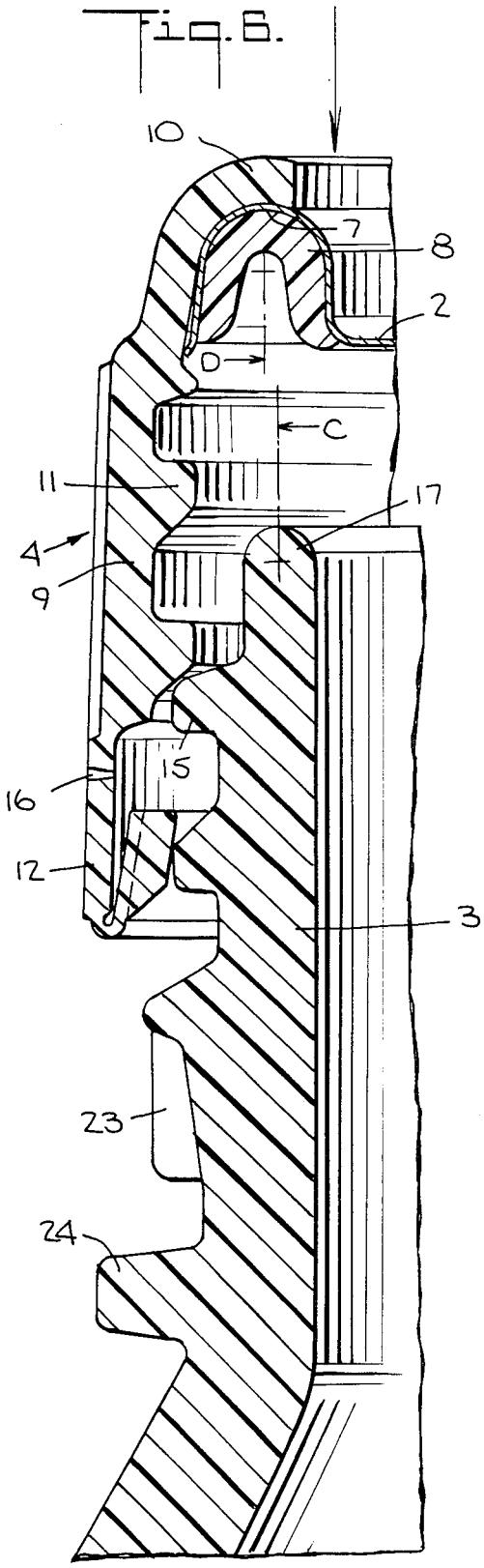

This is an improved composite closure for sealing retortable containers including plastic containers including those known as barrier plastic containers which are impervious to oxygen penetration and thereby extremely spoil resistant. Such plastic containers are often in the form of large mouth containers and there is a need for an inexpensive and efficient sealing closure. In addition to the requirements of low cost and an excellent seal, the closure must also retain its seal through the retorting or heat treating steps used in food packaging.

The figures illustrate a preferred embodiment of such a composite closure 1. It comprises a sealing cover or disc 2 which is held in sealing position on the container 3 at an outer channel or groove 7 by a molded plastic ring 4. A preferred cover 2 is illustrated in FIG. 3 which is formed from sheet metal into the illustrated shape comprising the disc-like inner portion 6 and an annular sealing groove 7 with a generally C-shaped cross section.

The plastic ring 4 has a skirt portion 9 and a generally inwardly and upwardly curved clamping portion 10 for engaging the cover 2 at the sealing groove 7. Container engaging threads 11 are provided on the inner surface of the ring 4 skirt 9 and preferably a tamper indicating band 12 is provided at the lower edge of the skirt 9. A line of weakness 16 is cut or molded between the tamper indicating strip 12 and the upper portion of the skirt 9.

The radially outer edge of the disc 2 includes the groove as illustrated at 7.

Figure 7:
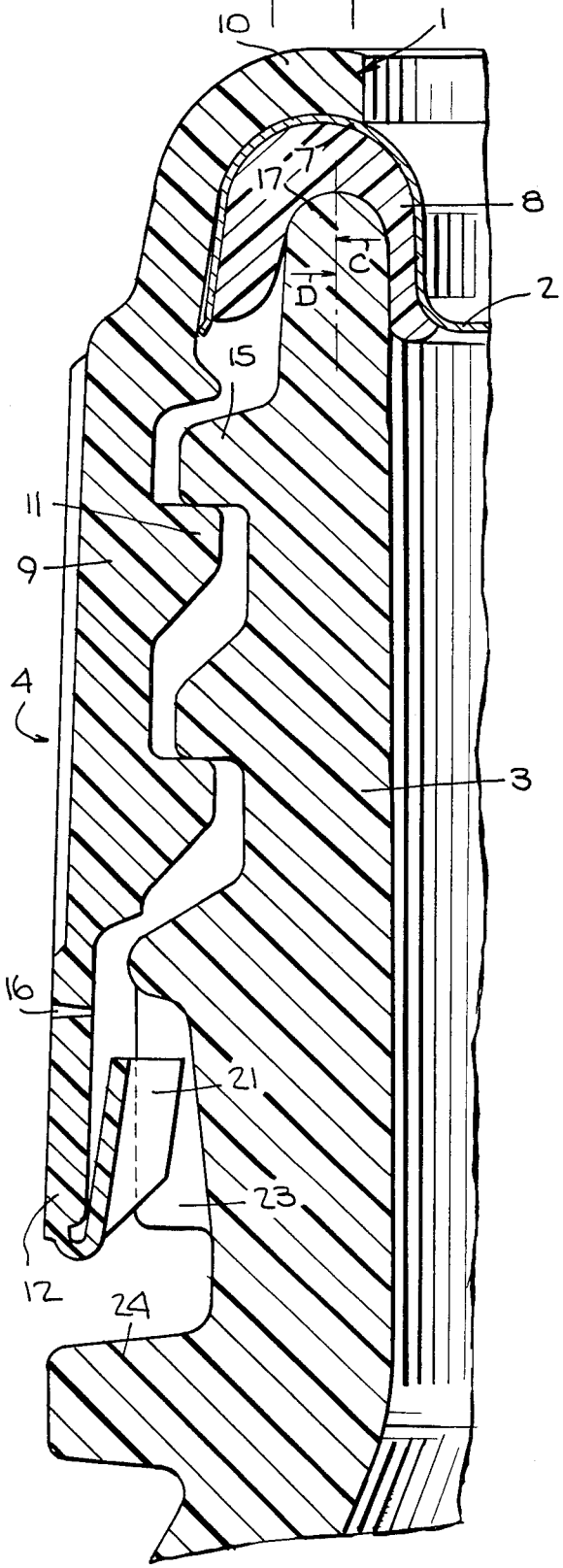
Figure 8:
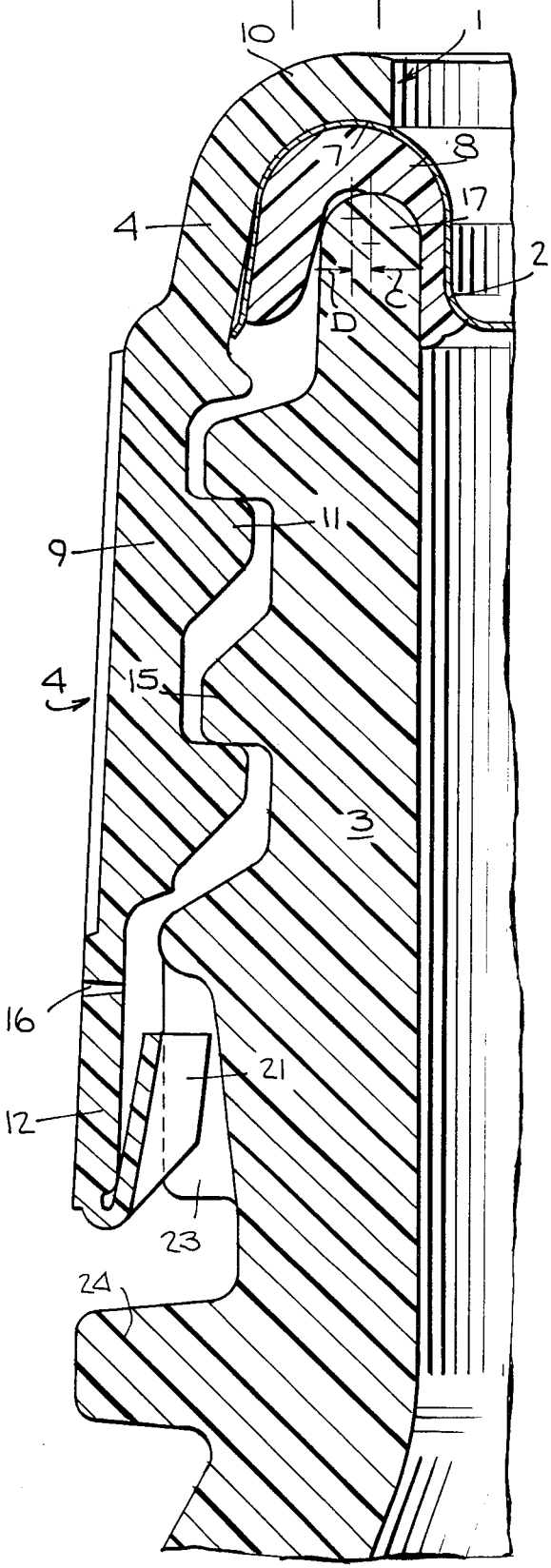

The groove 7 contains a plastisol or other sealant material 8 to form a vacuum tight seal with the container 3. The sealant 8 may be molded with a forming tool or applied as a spray or coating to the groove 7. The diameter C of the container 3 at its rim 17 is made smaller than the diameter D of the center line of the cover groove 7. This is done because the container 3 diameter increases more than the diameter of the groove 7 when the package is heated in the sealing or retorting operation. This means that the closure 1 as applied toot the hot container (FIG. 7) seals tightly and with the desired fit for the higher retorting temperature. When the sealed package cools (FIG. 8), the greater shrinkage of the container 3 rim 17 causes its radial diameter to become smaller than that of the groove 7 resulting in the creation of an inward radial sealing pressure between the inner edge of the sealant 8 and the container rim 17.

The container threads 15 and closure threads 11 have the preferred shape illustrated in which the bottom of the container threads 15 and the top of the closure threads 11 are made relatively flat and horizontal. The result is that any relative movement between the threads 11 and 15 during the retorting operation caused by the unequal expansion of the closure 1 and container 3 causes an insignificant relative vertical movement between the threads 11 and 15 so that the threads retain their vertical tension for both the heated and the cooled packages.

FIG. 11 illustrates a container 25 which comprises a similar barrier type finish which is blow molded or vacuum formed. This plastic container has the generally hollow form at the finish with the space between the inside and outside wall about three times the thickness of the barrier plastic. Otherwise the threads and beads and other features of the container finish are similar to these described for the container 3 of FIGS. 1–10.

DESCRIPTION OF THE TAMPER EVIDENT BAND

The composite closure takes advantage of its metal cover 2 to provide the usual flexible vacuum indicating button 20 which is held down after the container sealing to show the package vacuum and which pops up with an audible click when the package is opened to indicate to the user that the desired vacuum was present.

Additionally for most packages it is desirable to have a visual indicator in the form of a breakaway or tamper evident band provided on the lower edge of the plastic ring. The preferred band 12 is molded with spaced ratchets 21 with one or more ratchet teeth 22 thereon. The ratchets 21 are molded integrally with the ring 4 in a downward position as illustrated in FIG. 10 and are then bent upwardly, with or without heat, as illustrated in FIG. 5 to engage cooperating spaced molded ratchets 23 on the container 3.

The line of weakness 16 defines the band 12 from the upper portion of the ring 4. The ratchets 21 easily snap over the bead 24 in their hot and expanded and softened condition during sealing but are not easily moved once the sealed package cools.

When the closure 1 is first turned for removal, the engagement of the ratchets 21 on the band 12 and ratchets 23 on the container 3 cause the band 12 to be broken free at the line 16 from the ring 4 and to fall down to the container step 24. Additionally, the ratchets 21 and 23 interact to prevent premature unscrewing of the closure 1 while the ring 4 is soft and pliable during retorting.

The band 12 when broken away from the closure 1 and as the rest of the closure 1 rises on the container 3, remains positioned between the ratchets 23 and the container bead on step 24 so that it is not easily removed from the container.

The flexible ratchets 21 on the closure 1 bend outwardly should they happen to stop on a container ratchet 23 peak so that there is not distortion of the closure 1 skirt portion 9.

It has been found desirable to employ a closure cap such as described above for sealing containers having a top or finish generally similar to that for the container 3 but which are formed with a blowing or vacuum forming process. Such a container will have the hollow form illustrated in FIG. 11, but will operate otherwise in the manner already described.

It will be seen that an improved composite closure has been provided for sealing containers including plastic containers, which is capable of maintaining a tight seal through and after retorting.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A sealed package comprising the combination of:
   - a container 3;
   - a composite closure 1 having a metal cover 2 and a molded plastic ring 4 sealing the container;
   - a generally cylindrical annular sealing surface on the radially innermost surface of the container rim 17;
   - the annular outer edge of said metal cover 2 having a downwardly facing groove 7;
   - a grooved sealant 8 in said metal cover 2 groove 7; and
   - means creating a pressure contact between said container rim 17 annular sealing surface and the radially innermost surface of said sealant 8 groove provided by said sealant 8 groove at its center line D having a greater diameter than the diameter C of said container rim 17 at its center line when the container 3 is at room temperature.

2. The package as claimed in claim 1 in which said sealant 8 comprises plastisol.

3. The package as claimed in claim 1 in which said sealant 8 comprises a grooved plastisol.

4. The package as claimed in claim 1 which further comprises said molded plastic ring 4 having container engaging 11 for holding said cover 2 on the container 3.

5. The package as claimed in claim 4 which further comprises a tamper indicating tear strip 12 on said ring.

6. The package as claimed in claim 5 in which there are flexible ratchet means 21 releasably interlocking said tear strip 12 with the container 3 for tearing said tear strip 12 from said ring 4 upon removal of said closure 2.

7. The package as claimed in claim 6 which further comprises an enlarged diameter portion 24 on said container 3 downwardly from the lower edge of said plastic ring 4 for engaging said tear strip 12 when torn from said plastic ring 4.

8. The package as claimed in claim 4 in which said container engaging means 11 comprises threads with flat upper thread surfaces.

9. The package as claimed in claim 1 in which said sealant 8 is sprayed on said cover.

10. The package as claimed in claim 1 in which said sealant 8 comprises plastisol with a molded container rim 17 engaging groove.

11. The package as claimed in claim 1 in which the container 3 comprises a barrier plastic.

* * * * *